United States Patent [19]

Menne et al.

[11] Patent Number: 4,631,034

[45] Date of Patent: Dec. 23, 1986

[54] OUTBOARD MOTOR FOOT CONTROL

[75] Inventors: Eugene P. Menne, Mankato; William B. Lagerquist, North Mankato; Del P. Decko, Mankato, all of Minn.

[73] Assignee: Johnson Fishing, Inc., Mankato, Minn.

[21] Appl. No.: 602,773

[22] Filed: Apr. 23, 1984

[51] Int. Cl.[4] ..... B63H 25/02

[52] U.S. Cl. ..... 440/7; 114/153; 74/512; 74/471 R

[58] Field of Search ..... 440/6, 7; 114/153; 74/512, 471 R, 496

[56] References Cited

U.S. PATENT DOCUMENTS

| | | | |
|---|---|---|---|
| 2,507,894 | 5/1950 | Dorn, Jr. et al. . | |
| 2,514,467 | 7/1950 | Black . | |
| 2,627,833 | 2/1953 | Schroeder . | |
| 2,629,356 | 2/1953 | Whiting . | |
| 2,749,872 | 6/1956 | Amick . | |
| 2,757,630 | 8/1956 | Ottinger . | |
| 2,804,838 | 9/1957 | Moser . | |
| 2,838,021 | 6/1958 | West . | |
| 2,877,733 | 3/1959 | Harris . | |
| 2,890,595 | 6/1959 | Loeffler . | |
| 2,901,918 | 9/1959 | Beamer . | |
| 2,968,273 | 1/1961 | Corbett et al. . | |
| 2,988,037 | 6/1961 | Spencer . | |
| 2,988,930 | 6/1961 | McMurray et al. . | |
| 3,002,398 | 10/1961 | Beamer | 114/153 |
| 3,007,429 | 11/1961 | Sandman . | |
| 3,044,312 | 7/1962 | Hall et al. . | |
| 3,080,953 | 3/1963 | Edgemond, Jr. . | |
| 3,094,849 | 7/1963 | Breunich . | |
| 3,136,283 | 6/1964 | McCormick . | |
| 3,188,882 | 6/1965 | Whitehouse . | |
| 3,203,270 | 8/1965 | Booth . | |
| 3,475,985 | 11/1969 | Oldham . | |
| 3,598,079 | 8/1971 | Cudley | 114/153 |
| 3,602,181 | 8/1971 | Harris . | |
| 3,606,858 | 9/1971 | Edwards et al. . | |
| 3,659,475 | 5/1972 | Nichols . | |
| 3,796,292 | 3/1974 | Harrison . | |
| 3,807,345 | 4/1974 | Peterson . | |
| 3,889,625 | 6/1975 | Roller et al. . | |
| 4,009,678 | 3/1977 | North . | |
| 4,130,079 | 12/1978 | Rhorer et al. . | |
| 4,266,440 | 5/1981 | Berens . | |
| 4,292,859 | 10/1981 | Teraura . | |
| 4,295,385 | 10/1981 | Huttenhow . | |
| 4,386,918 | 6/1983 | Mathews et al. | 114/153 |
| 4,428,542 | 1/1984 | Kobayashi et al. . | |
| 4,527,983 | 7/1985 | Booth | 114/153 |

FOREIGN PATENT DOCUMENTS

| | | | |
|---|---|---|---|
| 609849 | 12/1960 | Canada | 114/153 |

*Primary Examiner*—Trygve M. Blix
*Assistant Examiner*—Thomas J. Brahan

[57] ABSTRACT

A portable outboard motor foot control device of the pull-pull cable type characterized by a cable house adjacent to the control pedal which, in highly embodiments, contains a pulley system for each of two cables and a pulley-bearing lever arm to move the cables. The lever arm is moved on a pivot shaft turned by the pedal to impart movement to the cables, providing considerable ease of operation. Some preferred embodiments include a pedal having a foot-contact surface well spaced from the pivot axis of the pedal, preferably above the axis.

20 Claims, 5 Drawing Figures

OUTBOARD MOTOR FOOT CONTROL

FIELD OF THE INVENTION

This invention is related generally to the control of outboard motors for boats and more specifically to portable foot pedal devices used to control outboard motors.

BACKGROUND OF THE INVENTION

Controlling the outboard motors used on fishing boats and the like is a task which may make it more difficult to attend to more enjoyable tasks, like fishing itself. To the extent that a fisherman must occupy his hands and arms in steering or otherwise controlling his boat, he loses the opportunity to concentrate on fishing.

Various foot pedal devices have been used in order to allow operators to control their outboard motors without the use of their hands and arms. Such foot pedal devices have been widely used to control electric trolling motors, particularly bow-mounted electric trolling motors.

A variety of foot pedal devices have been developed, including devices having a single "push-pull" cable and others having two "pull-pull" cables. In either case, each cable has an end secured within the foot pedal device and extending toward the outboard motor which it controls.

Such cables are usually used to steer the outboard motor. In the case of bow-mounted electric trolling motors, the cables are connected to apparatus causing a vertical motor-mounting shaft to turn to change the direction of the motor in the water.

The following U.S. Pat. Nos. disclose foot control devices of the prior art: 2,507,894; 2,757,630; 2,749,872; 2,804,838; 2,877,733; 2,901,918; 2,912,877; 2,968,273; 2,988,037; 2,988,930; 3,002,398; 3,475,985; 3,602,181; 3,606,858; 3,807,345; 3,889,625; 4,130,079; and 4,295,385.

The devices of the prior art include a number of push-pull and pull-pull cable systems having a variety of mechanical linkages, as well as other types of mechanical and electrical devices. Many of the mechanical devices, including pulley systems of various kinds, are built into the boat in the sense that various pulleys and cable guides are permanently attached to the boat. Examples of such devices included U.S. Pat. Nos. 2,912,877 and 2,749,872. Such devices lack portability and are not particularly useful as controls for electric trolling motors.

Fisherman using electric trolling motors often want to be fishing from different parts of their boats, and therefore may want to move the foot pedal control to accommodate their changed positions. For that reason, recent developments in foot pedal control devices relate primarily to portable devices, such as those disclosed in several of the above U.S. Pat. Nos. including: 2,804,838; 2,877,733; 2,968,273; 3,002,398; 3,602,181; 3,606,858; 3,807,345; 3,889,625; 4,130,079; 4,295,385.

This invention relates to foot pedal control devices of the portable type, which can be easily moved to various locations within the boat to accommodate the needs of the fisherman.

Pull-pull systems are often preferred over push-pull systems because they operate somewhat more easily and are less prone to develop mechanical problems. This invention applies to pull-pull systems.

Portable foot control devices of the prior art are often difficult to operate. More specifically, it is difficult to obtain accurate control of steering if substantial foot force must be applied just to get steering movement to start. This problem is made more acute by the fact that in certain devices of the prior art very small movements of the pedal will lead to major changes in steering direction. With this unfortunate combination of factors, oversteering can often result.

Lack of sufficient control is often experienced more at one portion of pedal movement and/or in one direction of pedal movement, thus further complicating control of the boat using such devices. There is a need for improvement in the ease of operation of portable foot control devices.

With many portable foot control devices of the prior art, operation is somewhat clumsy due to the nature of the foot movement required for operation. More specifically, with certain devices it is necessary to pivot the pedal through a substantial arc by applying only toe pressure or only heel pressure. This stresses the ankle and makes operation more difficult at a time the operator would like to be concentrating on his fishing.

Furthermore, with foot control pedals of the type having momentary switches as part of the pedal, simultaneous operation of the momentary switch and the foot pedal itself is just about impossible when the pedal is being pivoted in one direction. A momentary switch is used to actuate an electric trolling motor for short periods, to provide minute adjustments in boat position for fishing. Some momentary switches are slightly raised pads on the forward (toe) portions of the foot pedal. When heel pressure is being applied for steering, it is often very difficult if not impossible to keep the momentary switch actuated.

Thus, improvements are needed in the manner of operating foot pedal controls to make operation easier and more effective.

A further problem in certain foot control devices of the prior art is that, despite their portability, they are too limited in where they can be placed on the floor of the boat. This limitation is imposed by the coaxial cables which extend from the foot control devices to the outboard motor to be controlled. The cables (coaxial cables) are of necessity somewhat stiff and typically extend from the front of the pedal device. This prevents the operator from placing the foot control device in a forward position close to a bulkhead in his boat.

On the other hand, it is not desirable to design a foot control device to have the cables protruding straight up as would accommodate forward placement against a bulkhead, because in many other situations operators want the cables out of their way.

Improvements are needed in the configuration and/or operation of foot control devices in order to enlarge the area of possible placement of such devices in a boat.

BRIEF SUMMARY OF THE INVENTION

This invention is an improved portable foot control device for outboard motors overcoming the aforementioned problems of prior art devices.

The device is of the type having a base, a pedal mounted to the base to pivot about an axis, first and second pull-cables each of which have an end secured within the device and which extend generally from the front of the device toward the outboard motor. The foot control is a cable device of the pull-pull type.

The invention has a cable house secured to the base adjacent to the pedal. The cable house has front and rear ends, and is preferably immediately beside the pedal, although its position adjacent thereto could be underneath the pedal or at some other nearby position.

A pivot shaft which is linked to the pedal, preferably affixed thereto along the pivot axis of the pedal, extends into the cable house. A lever arm is fixed to the pivot shaft, preferably at a 90 degree angle thereto. The lever arm is movable within the cable house between forward and rearward positions as the pedal moves between the extremes of its possible positions.

The lever arm has first and second cable-turning means, preferably pulleys, secured thereon at or near its distal end. Such pulleys or other cable-turning means are thus movable with the lever arm between forward and rearward positions.

The two cables, called the first and second cables, are within the cable house, their ends being secured preferably within the cable house.

The end of the first cable is secured at a first position in front of the first cable-turning means, and extends from such first position toward the rear and around the first turning means and from there toward the front to exit the front of the cable house. The end of the second cable is secured at a second position to the rear of the second cable-turning means. It extends from such second position forwardly and around the second turning means and from there toward the rear around a third cable-turning means and from there toward the front to exit the front of the cable house.

This arrangement allows the movements of the lever arm and the cable-turning means thereon to pull the first and second cables. Movement of the lever arm toward its forward position pulls the second cable, while movement of the lever arm toward its rearward position pulls the first cable.

This arrangement provides substantial advantages in control of an outboard motor. More specifically, force is applied with a two-to-one mechanical advantage, making it easier to start movement of the cables. And, smaller movements of the control cables may be obtained more easily because the two-to-one ratio makes the device less sensitive than certain devices of the prior art. Thus, minute adjustments in steering may be made more accurately since they may be accomplished with pedal movements which are not unreasonably small. The problem of oversteering is overcome with this invention.

The first, second and third cable-turning means are preferably rotatably-mounted pulleys. The pulleys on the lever arm, referred to as first and second pulleys, are preferably on opposite sides of the lever arm, along a common axis which is parallel with the pivot axis of the pedal. The pulley which is the third cable-turning means is referred to as the third pulley.

The means securing the end of the first cable and the first pulley are preferably in alignment. Likewise, the means securing the end of the second cable and the second and third pulleys are preferably in alignment. Such alignments facilitates the stringing of the cables. The first and second cables, when strung, are in preferably generally parallel planes within the cable house.

In certain preferred embodiments, two guide pulleys are mounted in the forward part of the cable house, one in alignment with each of the first and second pulleys. The guide pulleys serve to guide the cables toward their exit from the cable house.

The cable house preferably includes two upright opposed plates spaced from one another in planes transverse the pedal pivot axis. The pivot shaft carrying the lever arm is journaled within the plates and the lever arm is between the plates. The third pulley is on another shaft extending between the plates and the guide pulleys are on a third shaft extending between the plates. The ends of the two cables are secured to the plates by pins, one cable end being attached to each of the two plates.

In highly preferred embodiments, the first and second pulleys exit the cable house through an adjustable device which sets the direction of such exit. This adjustable exit feature is the subject of a copending patent application entitled "Outboard Motor Foot Control with Adjustable Cables", filed by Eugene P. Menne concurrently with this application.

The adjustable device is a drum snapped into opposed circular openings in the forward portions of the opposed upright plates and frictionally held therebetween in a chosen orientation which dictates the angle at which the cables exit the cable house. The drum includes two exit passageways each receiving a cable from one of the guide pulleys. The cable is sheathed as it exits the passageways toward the controlled motor.

The drum can be rotated through a substantial arc, allowing the cable to exit the cable house in any direction from nearly straight forward to nearly straight up. The latter orientation allows the foot control device to be placed against a forward bulkhead or other structure which would otherwise have been an obstruction. This greatly increases the size of the area at which the foot control device can be placed to accommodate the needs of the operator.

In highly preferred embodiments, the pedal member has a foot-contact surface which is well spaced from the pivot axis of the pedal. Such spacing should be sufficient such that during movements of the pedal the extent of fore-to-aft movement of that portion of the foot-contact surface which is closest to the pivot axis of the pedal is about equal to or greater than the extent of fore-to-aft movement of the lever arm. In judging fore-to-aft movement of the lever arm, the point at which the first and second pulleys are attached to the lever arm is the appropriate point to consider.

Such spacing is preferably such that the foot-contact surface is above the pivot axis.

Such arrangement of foot-contact surface and pivot axis provides substantial operational advantages. Rather than applying force to the pedal almost solely through the toe or heel, depending on the intended direction, the foot-contact surface of the pedal can itself move forward or backward. This substantially reduces stress on the operator's ankle and makes operation noticeably easier.

Such arrangement of foot-contact surface and pivot point also allows a momentary switch to be operated during pedal pivoting movements in both directions. If a slightly raised momentary switch is located on the forward portion of the foot-contact surface, pressure to actuate the momentary switch can still be applied even though the pedal is being pivoted toward the heel. It is never necessary to stop applying pressure altogether on any portion of the pedal in order to make it move in one direction or the other.

The combination of parts and features forming this invention provides a foot control device overcoming many shortcomings and problems of prior art devices. The foot control device of this invention can be made compact and with a low profile, characteristics deemed desirable by boat operators.

OBJECTS OF THE INVENTION

An object of this invention is to provide an improved foot control device for outboard motors.

Another object of this invention is to provide a foot control device for outboard motors which may be operated for long periods with much less ankle stress than prior devices.

Another object of the invention is to provide a foot control device for outboard motors which requires less force to effect movement of the control cables.

Yet another object of this invention is to provide a foot control device for outboard motors which eliminates oversteering problems of certain prior devices.

Another object of this invention is to provide a foot control device for outboard motors which gives more accurate control in steering a boat.

Still another object of this invention is to provide a foot control device for outboard motors which allows easy operation of a momentary switch on the foot-contact surface when the pedal is being moved in either direction.

Another object of this invention is to provide a portable foot control device for outboard motors having the above advantages and further having improved flexibility in placement in a boat, even allowing placement closely against forward bulkheads in a boat.

These and other important objects will be apparent from the following description of preferred embodiments of the invention and from the accompanying drawings wherein:

DETAILED DESCRIPTION OF PREFERRED EMBODIMENTS

Figure 1:
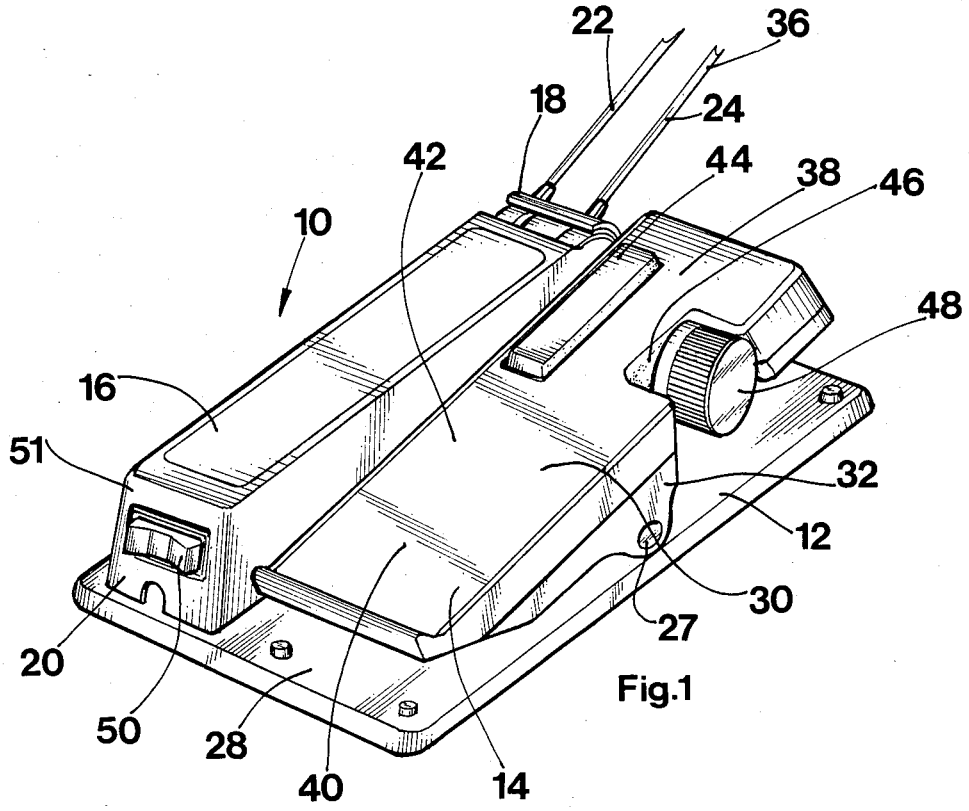
FIG. 1 is a perspective view of a foot control device in accordance with this invention taken generally from a rear position.

The figures illustrate an outboard motor foot control device 10 in accordance with this invention. Foot control device 10 includes a base 12, a pedal 14, and a cable house 16 having a front end 18 and a rear end 20. A first cable 22 and a second cable 24 extend from front end 18 of cable house 16.

Figure 3:
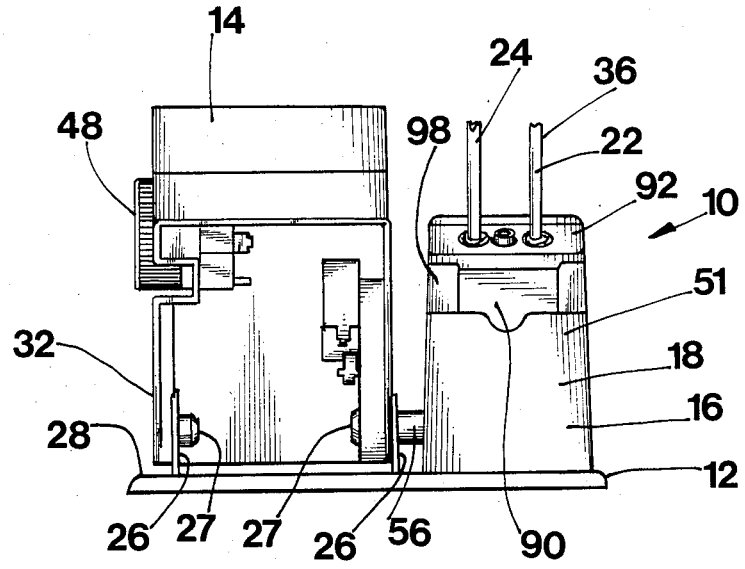
FIG. 3 is a front elevation.

As illustrated best in FIG. 3, pedal 14 is mounted pivotably to upright portions 26 of base 12 by pivot pins 27, and such pivotable mount defines a horizontal pivot axis just above the main upper surface 28 of base 12. Pedal 14 includes a foot-contact surface 30, which is spaced substantially above the axis defined by pivot pins 27, and downwardly extending side portions 32 which are apertured to accommodate pivot pins 27.

Foot-contact surface 30 of pedal 14 includes a forward portion 38, a rearward portion 40, and a center portion 42 which is the part of foot-contact surface closest to the pivot axis of pedal 14. On forward portion 38 is a momentary switch 44 which is slightly raised above foot-contact surface 30 and located to one side. On the other side of foot-contact surface 30, exposed through a notch 46 in surface 30, is a cylindrical speed control knob 48.

Momentary switch 44 and control knob 48 are connected by appropriate mechanical and electrical devices not shown to perform their intended functions. Depression of momentary switch 44 may be used to actuate an electric outboard motor to which control 10 is attached, and speed control knob controls the speed of the motor. A three-way switch 50 mounted on rear end 20 of cable house 16 and electrically connected by appropriate means not shown is used to turn the motor "off" or to turn it to either a continuous "on" position or to a position allowing operation of momentary switch 44.

Movement of pedal 14 in forward or rearward directions moves the inner cable portions 34 of first and second cables 22 and 24 through the mechanical device to be hereafter described, most of which is within cable house 16. First and second cables 22 and 24 are within sheathings 36 as they exit cable house 16.

Figure 2:
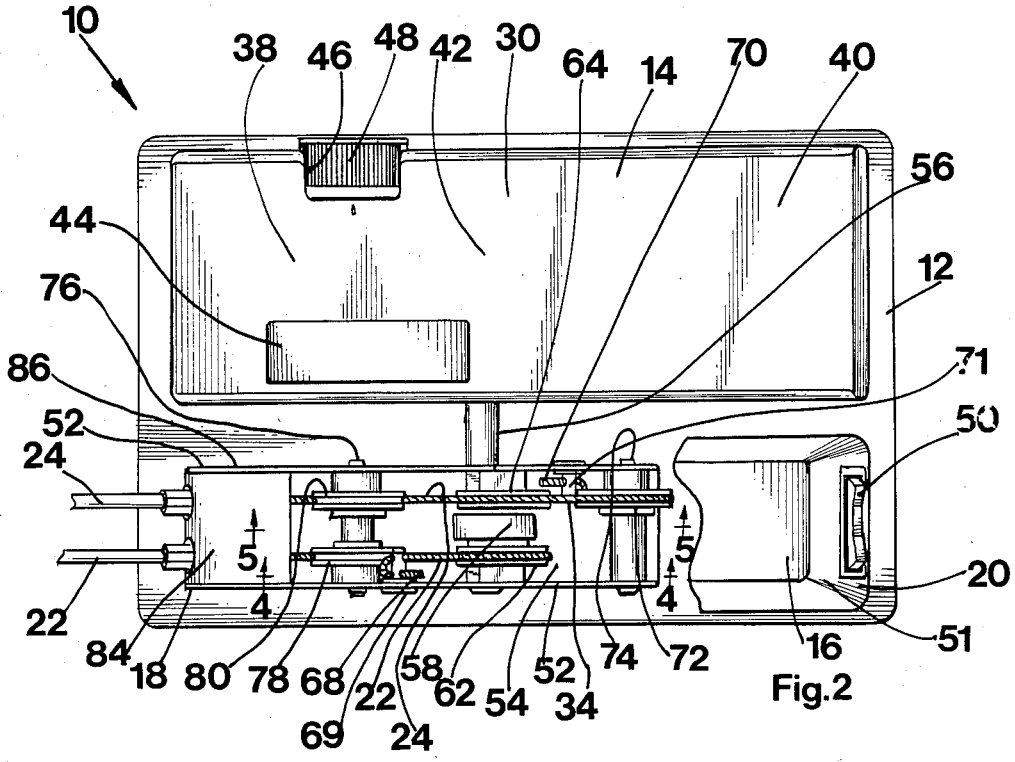
FIG. 2 is top plan view with a portion of the cable house casing cutaway to expose working parts.
Figure 4:
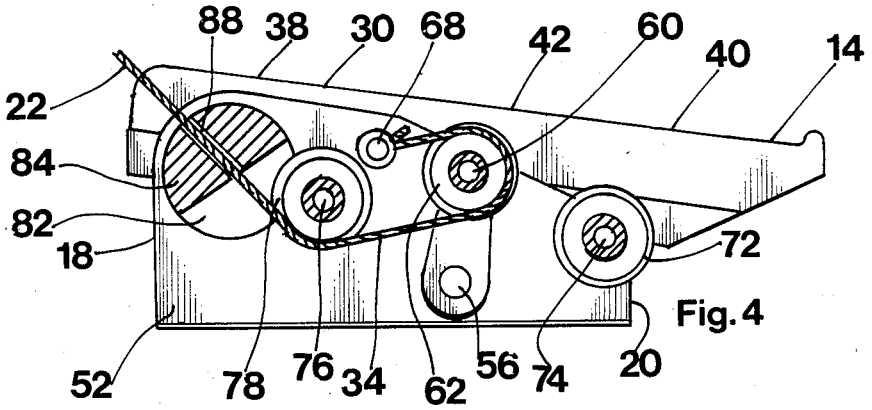
FIG. 4 is a partial right side sectional view taken along section 4—4 as shown in FIG. 2, with the cable house casing entirely removed.
Figure 5:
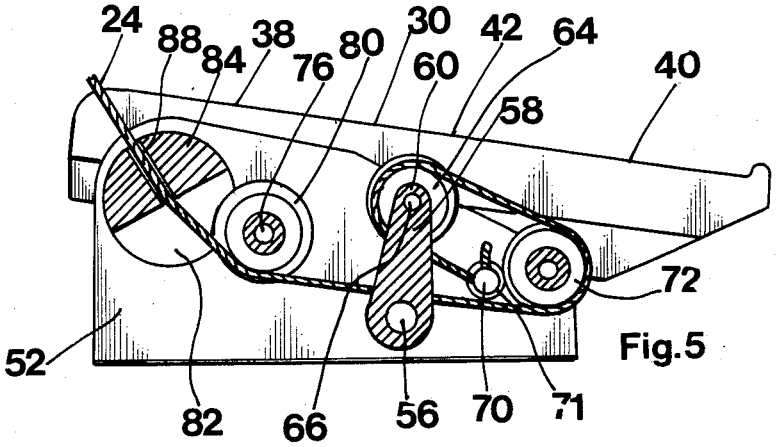
FIG. 5 is a partial right side sectional view taken along section 5—5 as shown in FIG. 2, with the cable house casing entirely removed.

As best illustrated by FIG. 2, cable house 16 includes a cover 51 shielding the inner working parts. FIGS. 2, 4 and 5 illustrate two vertical opposed plates 52 which are in spaced parallel planes perpendicular to the pivot axis of pedal 14. Opposed plates 52 are the opposite leg portions of a U-shaped metal piece the bottom 54 of which is attached to base 12. First and second cables 22 and 24 are strung on two sets of pulleys arranged between opposed plates 52.

Attached to the pivot pin 27 which is adjacent to cable house 16 and extending into cable house 16 along the axis defined by pivot pins 27 is a pivot shaft 56 which is affixed to pedal 14 and turns therewith. Pivot shaft 56 extends through both of the plates 52 and is journaled therein.

A lever arm 58 is fixed to pivot shaft 56 between plates 52 and is oriented at a right angle to pivot shaft 56. Lever arm 58 extends in a generally upward direction from the point of its attachment to pivot shaft 56 and is free to move between forward and rearward positions as determined by the position of pedal 14.

At the distal end 60 of lever arm 58 are first and second pulleys 62 and 64, each of which are rotatably mounted on a shaft 66 as illustrated in FIGS. 4 and 5. First and second pulleys 62 and 64 are on opposite sides of lever arm 58. First and second pulleys 62 and 64 can move with lever arm 58 between forward and rearward positions.

The end 68 of first cable 22 is secured by a pin 69 to one of the plates 52 at a first position in front of first pulley 62. The end 70 of second cable 24 is secured by a pin 71 to the other of the plates 52 at a second position to the rear of second pulley 64. Also to the rear of second pulley 64 is a third pulley 72 which is rotatably mounted on shaft 74 which extends between plates 52 and is parallel to pivot shaft 56 and shaft 66. Another parallel shaft 76 extends between plates 52 to rotatably mount first and second guide pulleys 78 and 80.

First cable 22 extends from the first position, where it is secured, in a rearward direction to and around first pulley 62 and from there forward to first guide pulley 78 which serves to guide it toward its exit from cable house 16, as illustrated in FIG. 4. As shown in FIG. 5, second cable 24 extends from the second position, where it is secured, in a forward direction to and around second pulley 64 and from there in a rearward direction to and around third pulley 72 and from there in a forward direction to second guide pulley 80 which serves to guide second cable 24 toward its exit from cable house 16.

Each of the cables is generally in a plane within cable house 16 and such planes are parallel. Furthermore, pin 69, first pulley 62 and first guide pulley 78 are in alignment in a fore-to-aft direction. Likewise, pin 71, second pulley 64, third pulley 72 and second guide pulley 80 are in alignment in a fore-to-aft direction.

As shown in FIGS. 4 and 5, the forward portions of the opposed plates 52 have broad circular opposed apertures 82 between which a drum 84 is held in tight frictional engagement. Drum 84 has raised center portions 86 on its ends which are snapped into opposed apertures 82 and serve to hold drum 84 in place. Drum 84 has two transaxial passageways 88, one in line with each of the cables. Cables 22 and 24 extend through passageways 88 and their direction in exiting cable house 16 is set by the rotational orientation of drum 84. The drum can be rotated to point cables 22 and 24 in a nearly vertical direction or in a horizontal direction or any direction between these extremes.

A forward opening 90 is defined in cover 51 to expose drum 84 and allow cables 22 and 24 to exit cable house 16. A yoke 92 outside cover 51 is attached to drum 84 to secure cables 22 and 24 at their point of exit and to provide a stop protecting the cables during adjustment of the rotational position of drum 84 and attached yoke 92.

In operation, movement of pedal 14 in a forward direction moves lever arm 58 and first and second pulleys 62 and 64 in a forward direction. Such movement results in the pulling of second cable 24 and the corresponding payout of first cable 22. Movement of pedal 14 in a backward direction moves lever arm 58 and first and second pulleys 62 and 64 in a rearward direction, which results in the pulling of first cable 22 and the corresponding payout of second cable 24. These cable movements produce the desired steering, and do so with ease and accuracy.

The spacing of foot-contact surface 30 above the pivot axis of pedal 14 is large enough that when pedal 14 is moved the extent of the fore-to-aft movement of center portion 42 of foot-contact surface 30 is greater than the extent of fore-to-aft movement of shaft 66 on lever arm 58, the point of connection of first and second pulleys 62 and 64 to lever arm 58. If the spacing were less, then pedal control would be more difficult and stressful for the ankle. The substantial spacing allow movement of the operator's foot along an arc to some extent as well as mere pivoting.

This makes it possible to operate momentary switch 44 even when pedal 14 is being moved in the rearward direction, with more pressure applied to rearward portion 40 than to forward portion 38. During such movement, enough pressure can be applied to forward portion 38 of pedal 14 to operate momentary switch 44.

Pulleys are highly preferred in this invention. However, other cable-turning means could be used.

The parts of this invention are preferably made of metal or strong plastic. Appropriate materials would be apparent to those skilled in the art who are made familiar with this disclosure.

While in the foregoing specification this invention ha been described in relation to certain preferred embodiments and many details have been set forth for purpose of illustration, it will be apparent to those skilled in the art that the invention is susceptible to additional embodiments and that certain of the details described herein can be varied considerably without departing from the basic principles of the invention.

What is claimed is:

1. In a portable outboard motor foot control device of the type having a base, a pedal mounted thereto pivotably about an axis, and first and second pull-cables each of which have an end secured within the device and extend from the front thereof toward the controlled motor, the improvement comprising:

a cable house secured to the base adjacent to the pedal and having front and rear ends;

a pivot shaft linked to the pedal and extending into the cable house;

a lever arm fixed to the shaft within the cable house and having first and second cable-turning means thereon movable therewith between forward and rearward positions;

means securing the end of the first cable at a first position in front of the first turning means, said first cable extending from the first position around the first turning means to exit the front end of the cable house;

a third cable-turning means secured within the cable house to the rear of the second turning means; and means securing the end of the second cable at a second position to the rear of the second turning means, said second cable extending from the second position around the second turning means and from there around the third turning means to exit the front end of the cable house;

whereby movements of the lever arm toward its forward and rearward positions pull the second and first cables, respectively.

2. The foot control device of claim 1 wherein the first and second cable-turning means are first and second pulleys rotatably mounted on the lever arm in axially spaced positions.

3. The foot control device of claim 2 wherein the first and second pulleys are on opposite sides of the lever arm.

4. The foot control device of claim 3 wherein the third cable-turning means is a pulley rotabably mounted in alignment with the second pulley.

5. The foot control device of claim 4 wherein the means securing the end of the first cable is in alignment with the first pulley and the means securing the end of the second cable is in alignment with the second and third pulleys, said first and second cables being in generally parallel planes within the cable house.

6. The foot control device of claim 5 further including first and second guide pulleys mounted with respect to the cable house at a position forward of the first and second pulleys, said first and second guide pulleys being in alignment with the first and second pulleys, respectively, and serving to guide the cables toward their exit from the cable house.

7. The foot control device of claim 5 wherein the cable house comprises two substantially vertical opposed plates in spaced planes transverse said axis, said pivot shaft extending between said plates and being journaled therein and wherein the third pulley is on another shaft extending between said plates.

8. The foot control device of claim 7 further comprising first and second guide pulleys mounted on a third shaft extending between the opposed plates at a position forward of the first and second pulleys, said first and second guide pulleys being in alignment with the first and second pulleys, respectively, and serving to guide the cables toward their exit from the cable house.

9. The foot control device of claim 8 wherein the pivot shaft is affixed to the pedal along the axis.

10. The foot control device of claim 9 further comprising adjustable means to set the direction of the cables as they exit the cable house, such that the cables can avoid nearby obstacles.

11. The foot control device of claim 7 wherein the means securing the ends of the first and second cables are pins attached to the opposed plates, respectively.

12. The foot control of claim 1 wherein the pedal has a foot-contact surface which is spaced from the axis by a distance sufficient such that during movements of the pedal the extent of fore-to-aft movement of that portion of the foot-contact surface which is closest to the axis is at least about as great as the extent of fore-to-aft movement of the lever arm.

13. The foot control of claim 12 wherein the foot-contact surface is spaced above the axis.

14. The foot control device of claim 13 further comprising a momentary switch on a forward portion of the foot-contact surface and slightly raised above such surface.

15. The foot control device of claim 14 wherein the first and second cable-turning means are first and second pulleys rotatably mounted on the lever arm in axially spaced positions and the third cable-turning means is a pulley rotabably mounted in alignment with the second pulley.

16. The foot control device of claim 15 wherein the first and second pulleys are on opposite sides of the lever arm and wherein the means securing the end of the first cable is in alignment with the first pulley and the means securing the end of the second cable is in alignment with the second and third pulleys, said first and second cables being in generally parallel planes within the cable house.

17. The foot control device of claim 16 wherein the cable house comprises two substantially vertical opposed plates in planes transverse said axis, said pivot shaft extending between said plates and being journaled therein and wherein the third pulley is on another shaft extending between said plates.

18. The foot control device of claim 17 further comprising first and second guide pulleys mounted on a third shaft extending between the opposed plates at a position forward of the first and second pulleys, said first and second guide pulleys being in alignment with the first and second pulleys, respectively, and serving to guide the cables toward their exit from the cable house.

19. The foot control device of claim 18 wherein the pivot shaft is affixed to the pedal along the axis.

20. The foot control device of claim 19 further comprising adjustable means to set the direction of the cables as they exit the cable house, such that the cables can avoid nearby obstacles.

* * * * *